US005109988A

United States Patent [19]

Artiano

[11] Patent Number: 5,109,988

[45] **Date of Patent: * May 5, 1992**

[54] MACHINE AND METHOD FOR SORTING OUT FINES, PINS, AND OVER-THICK WOOD CHIPS

[75] Inventor: Adrian Artiano, Oregon City, Oreg.

[73] Assignee: Acrowood Corporation, Everett, Wash.

[ * ] Notice: The portion of the term of this patent subsequent to Feb. 27, 2007 has been disclaimed.

[21] Appl. No.: 485,310

[22] Filed: Feb. 26, 1990

Related U.S. Application Data

[63] Continuation-in-part of Ser. No. 155,270, Feb. 12, 1988, Pat. No. 4,903,845, and a continuation-in-part of Ser. No. 296,756, Jan. 1, 1989, Pat. No. 5,012,933.

[51] Int. Cl.[5] ..... B07B 13/04

[52] U.S. Cl. ..... 209/673; 209/618; 209/671

[58] Field of Search ..... 209/673, 671, 660, 667, 209/668, 670, 669, 44.1, 618, 630, 632

[56] References Cited

U.S. PATENT DOCUMENTS

| | | | |
|---|---|---|---|
| 1,424 | 12/1839 | Clark | 209/12 |
| 1,899,292 | 2/1933 | Rienks | 209/671 X |
| 2,266,506 | 12/1941 | Morse | 209/671 |
| 2,370,539 | 2/1945 | Hodecker | 209/668 |
| 3,438,491 | 4/1969 | Haley et al. | 209/673 |
| 3,817,375 | 6/1974 | Herkes | 209/673 |
| 4,376,042 | 3/1983 | Brown | 209/672 X |
| 4,430,210 | 2/1984 | Tuuha | 209/669 X |
| 4,903,845 | 2/1990 | Artiano | 209/673 X |

FOREIGN PATENT DOCUMENTS

| | | | |
|---|---|---|---|
| 3116699 | 1/1982 | Fed. Rep. of Germany | 209/673 |
| 86/01580 | 3/1986 | World Int. Prop. O. | 209/671 |

OTHER PUBLICATIONS

Smith, et al., "The State of the Art in Chip Fines Screening", *Tappi Journal*, Sep. 1989, pp. 143–149.

*Primary Examiner*—Donald T. Hajec
*Attorney, Agent, or Firm*—Seed and Berry

[57] ABSTRACT

Fines, pins, and over-thick wood chips are separated from wood chip material by using a series of three roller screens having chip agitating and conveying protuberances. The screens are arranged and adapted such that over-thick chips are separated by the first screen, fines are separated by the second screen, and pins are separated by the third screen.

15 Claims, 5 Drawing Sheets

FIG.9
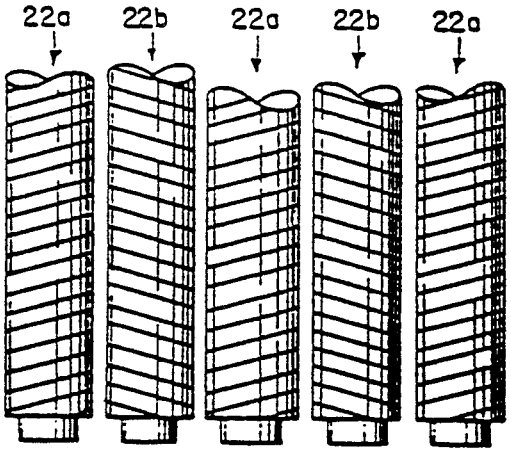
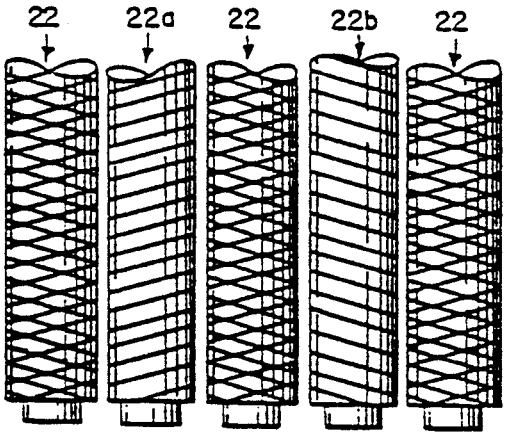
FIG.10
FIG.11
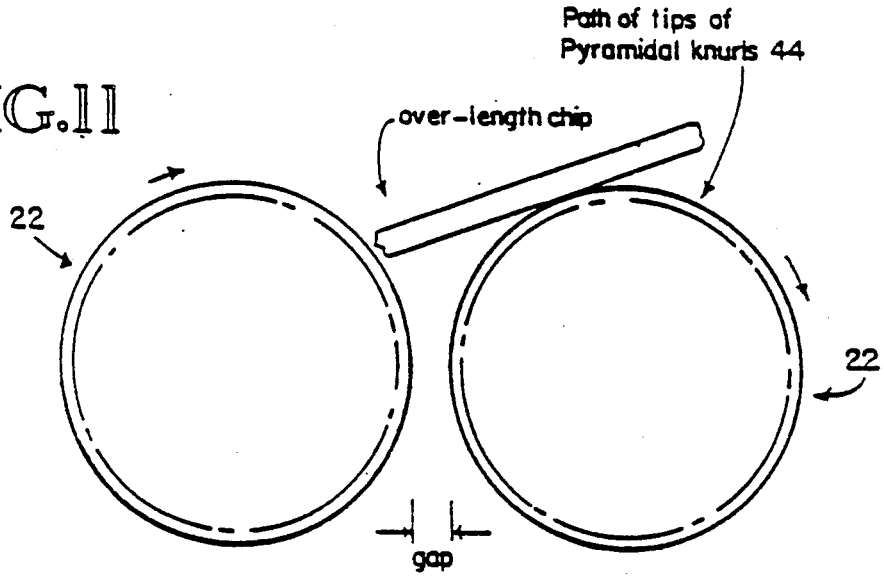

MACHINE AND METHOD FOR SORTING OUT FINES, PINS, AND OVER-THICK WOOD CHIPS

CROSS-REFERENCE TO RELATED APPLICATION

This application is a continuation-in-part of my copending applications Ser. No. 155,270, filed Feb. 12, 1988, now U.S. Pat. No. 4,903,845 and Ser. No. 296,756, filed Jan. 1, 1989, now U.S. Pat. No. 5,012,933.

TECHNICAL FIELD

The present invention relates to the sorting of wood chip material into over-thick chips, fines, pins, and acceptable chips.

BACKGROUND ART

In the processing of wood chips preparatory to introduction to a digester, it is preferred to reprocess chips which are thicker than a predetermined thickness (commonly about 8 mm) and to discard those chip particles which have fibers shorter than a preset minimum length or which are in the form of flakes thinner than a preset thickness, because these are relatively poor digesting materials. For purposes of the present description, the chips to be reprocessed will be called "over-thick" and the chip particles with overly short fibers and flakes will be called "fines."

"Pins" are an additional category of particles in wood chip material which it is preferred to take into consideration in many pulping operations since they do not result in as high a quality of pulp as do normally acceptable chips and can cause plugging in the digester. Pins may be classified as a toothpick-like material which will pass through a 7 mm round hole on a Statsvets-type separator, but not through a 3 mm round hole. When pins are classified in this manner, fines are considered to be sawdust-like material that, when wet, will pass through a 3 mm round hole on a Statsvets-type classifier.

The advantage of initially separating a relatively large percentage of the pins is that they may be accurately blended in a predetermined amount with the otherwise acceptable chips if they are to be used in the pulping operation, or can be discarded in whole or in part with the fines. In operations in which the pins are not separated as a class, the smaller pins become part of the fines and the remaining pins become part of the acceptable chips.

The screening of wood chip material is not only difficult because of the presence of fines and pins, but it is also complicated by the fact that the chips normally vary in length from about 20 to 30 mm and in width from about 15 to 20 mm. Thus, the thickness of the chips is usually considerably smaller than the other dimensions.

The traditional screening apparatus for pulp chips have been (a) sloped, vibratory holed screens given an oscillating or circular motion, commonly in the range of 2 to 3 inches, at a relatively high speed to shift the properly sized chips through the holes in the screen, and (b) disk screens such as that shown, for example, in U.S. Pat. No. 4,301,930, which comprises a bed of parallel, co-rotating shafts carrying interdigitated disks having a clearance defined by the maximum chip thickness to be tolerated.

Disk screens have been considered by many in the cellulose industry as superior to vibratory screens; but as indicated in U.S. Pat. No. 4,660,726, disk screens have a relatively low screening capacity per square meter of screening surface, and, as indicated in U.S. Pat. No. 4,538,734, it is very difficult to attain and maintain uniform slot widths between the disks of a disk screen, particularly when the slot widths are required to be so narrow. As a consequence, there have been efforts to provide improved techniques for mounting and replacing the disks of disk screens and attempts to develop a suitable alternative to disk screens. Such attempts have included oscillating bar screens, such as shown in U.S. Pat. No. 4,660,726, and synchronously driven, intermeshing screw spirals, such as disclosed in U.S. Pat. No. 4,430,210.

DISCLOSURE OF THE INVENTION

Although roll screens or grizzlies have long been used for sizing or separating various products, they have not been considered as suitable for separating over-thick chips, pins, or fines from wood chip material. Nor have they been considered as suitable for removing chips classified as normally "over-length." In the past it was not recognized that roll screens could be used successfully for sorting functions with respect to wood chips if the surface of the rollers was such as to adequately agitate the chips and assist the conveying action of the rollers.

In carrying out the invention, there is utilized a plurality of side-by-side, transversely spaced rollers which collectively provide a bed for receiving the wood chips to be sorted and have their surface provided with chip agitating protuberances. These protuberances may be knurls and/or ridges when separating out over-thick chips, and are preferably knurls when separating out fines and pins. The rollers are rotated in the same direction so that the protuberances function to tumble and push the chips along the bed. When the protuberances on the rollers are knurls, they are preferably pyramidal (full pyramids or frustums of pyramids); and when the protuberances are ridged, the ridges are preferably tapered and helical for the length of the rollers (the width of the bed). When pyramidal protuberances are used, they preferably are formed by two helical sets of routed V-grooves of opposite hand; and when the protuberances are ridges, they are preferably formed by a single helical set of routed V-grooves.

When separating out the over-thick chips, the gaps between rollers are sized to receive only the chips of proper thickness ("acceptable chips"). As the rollers rotate, the acceptable chips, together with the fines and pins, occupying the spaces between the rollers above the sizing gaps pass downwardly through the gaps and preferably onto a second roller bed. The over-thick chips in the spaces between the rollers are nudged ahead by the oncoming chips and continue to be conveyed along the first roller bed by the rollers for discharge from the forward end of the bed for reprocessing.

The second roller bed is used to separate out the fines, and it is preferred to use rollers with pyramidal knurls for this purpose. The spaces between the knurls are sized to receive primarily the fines having too short a fiber length, and the rollers are preferably spaced apart at their maximum diameter by a gap sufficient to pass the fines having the form of flakes which are too thin. As the rollers rotate, the fines occupying the spaces between the knurls and between the rollers pass downwardly from the roller bed and discharge into a hopper or onto a discharge conveyor. The tumbling of the chips by the knurls causes the fines to settle between the knurls and between the rollers for discharge. At the same time, the tumbling chips are conveyed by the rotating roller action along the second bed for discharge as acceptable chips and pins to a third roller bed, which may be a continuation of the second bed and have a larger gap between rollers for passage therebetween of the pins for collection. The remaining chips ("acceptable chips") discharge from the third bed. In the preferred practice, only the material passing between the rollers in about the first half of the length of the first bed is fed onto the second roller bed because this material normally contains all of the collectible fines and in excess of 80% of the pins. The chips passing through the remaining rollers in the first bed are then classified a "acceptable chips" and are combined with the chips discharging from the third roller bed.

Typical rollers can have, for example, a diameter of 3.5 inches, a protuberance depth of 0.1 inch, a protuberance width and spacing of 0.25 inch, and a helix angle of 27 degrees. Typical rollers for removal of fines and pins are preferably of smaller diameter, such as, for example, 2.187 inches. The rollers on the fines-separating bed may have their knurl depth about one-half that on the rollers of the previous bed, and the knurl depth on the rollers of the pins-separating bed may be the same as for the rollers for sorting out over-thick chips.

BRIEF DESCRIPTION OF THE DRAWINGS

FIG. 9 is a fragmentary plan view showing an arrangement of the second embodiment of rollers.

FIG. 10 is a fragmentary plan view showing an alternative arrangement combining use of the first and second embodiment of rollers.

FIG. 11 shows the action of the rollers with respect to an over-length chip when viewed from one end of the rollers.

BEST MODE FOR CARRYING OUT THE INVENTION

Figure 1:
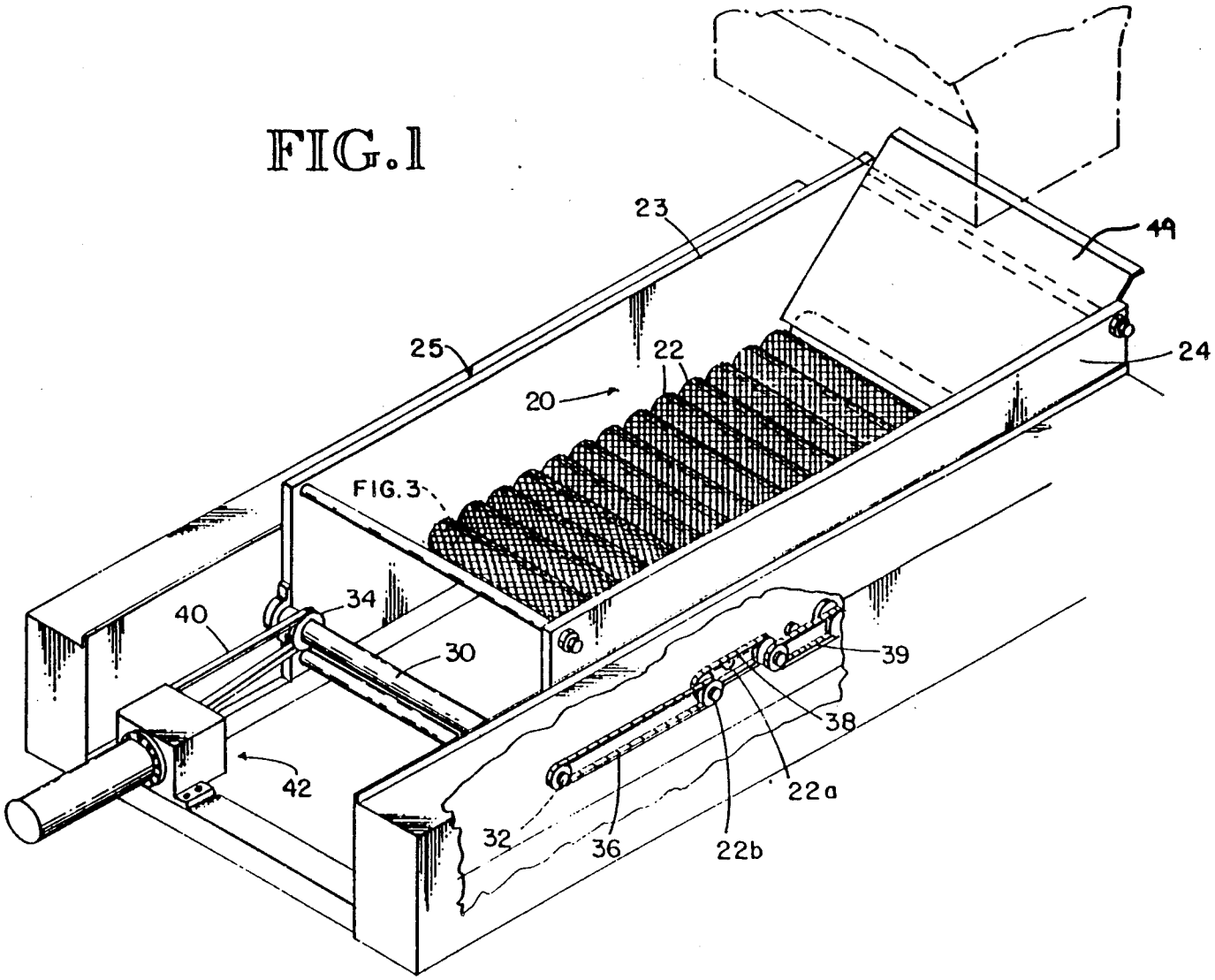
FIG. 1 is a top perspective of a machine embodying a roller bed in accordance with the present invention.
Figure 2:
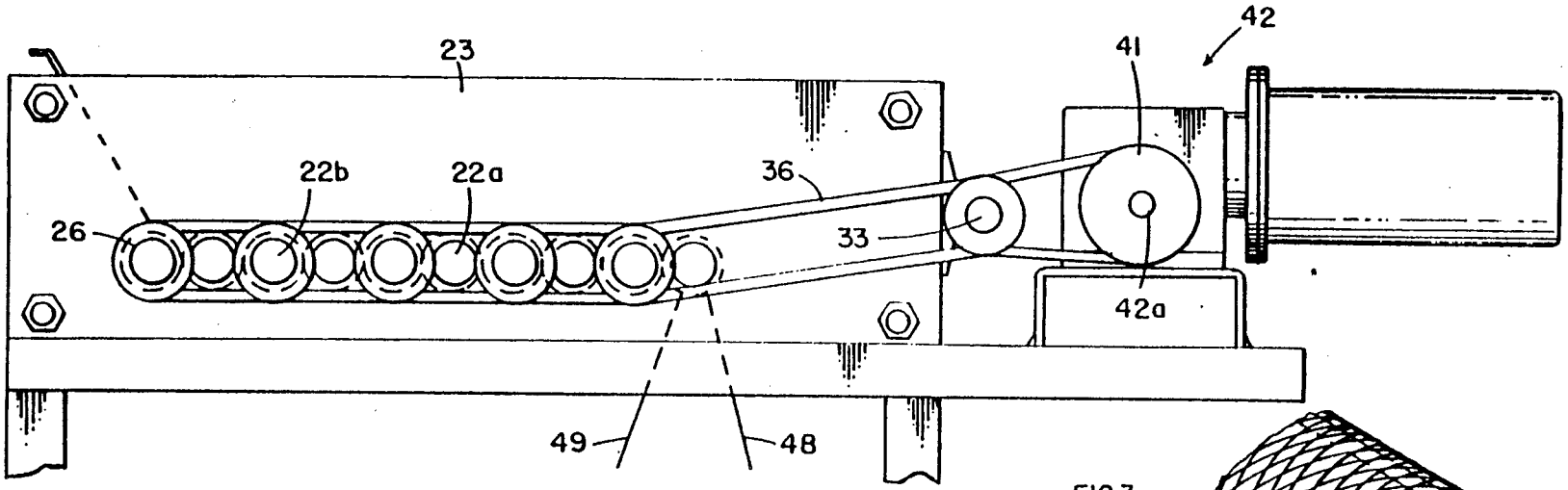
FIG. 2 is a side elevational view of the machine as viewed from the left in FIG. 1 and without a side cover plate.
Figure 4:
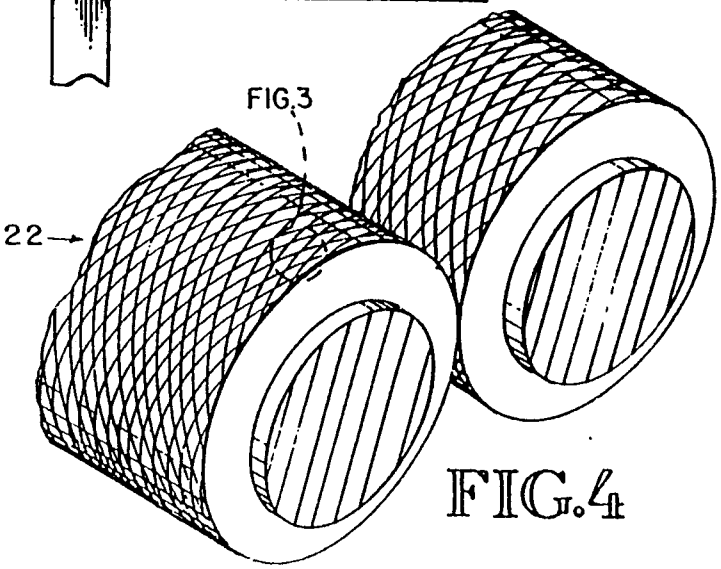
FIG. 4 is a fragmentary perspective view showing end portions of two of the knurled rollers of the first embodiment having pyramidal knurls.

Referring to the drawings, a bed 20 is formed by a plurality of side-by-side, knurled rollers 22 which have parallel rotary axes. These rollers are journal-mounted between upstanding side plates 23, 24 provided as part of a framework 25. The rollers 22 are necked at each end, and the necks **22*a*, 22*b* extend through bearings mounted in the side plates 23, 24. Neck 22*b* of each roller 22 is extended relative to neck 22*a* to receive a single sprocket 26 in the case of the two rearmost rollers and to receive inner and outer sprockets 27, 28** in the case of the other rollers.

It will be noted that alternate of the rollers 22 is reversed endwise so that there are two sets of sprockets, one set being outboard of side plate 23 and the necks **22*a* of the second set, and the second set being outboard of side plate 24 and the necks 22*a* of the first set. At the forward end of the side plates 23, 24, there is mounted a cross-shaft 30, in turn having end sprockets 32, 33 and an intermediate sprocket 34. The end sprockets are connected by chains 36 to the most forward outer sprocket 28 on the respective side of the machine. Alternating inner and outer chains 38, 39 then alternately connect the inner and outer sprockets to drive alternate of the rollers 22 at one side of the machine and to drive the other rollers at the other side of the machine from the shaft 30. The latter is in turn powered by a chain 40 from a drive sprocket 41 on the output shaft 42*a* of a variable-speed drive unit 42 mounted at the front of the framework 25**. The described drive arrangement permits rollers with a relatively small diameter, and which are close together, to be used and driven in a simple manner in the same direction of rotation from a single motor.

Figure 6:
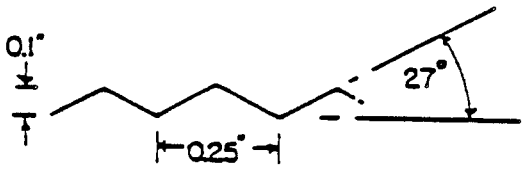
FIG. 6 is a fragmentary view to an enlarged scale showing an example of suitable dimensions for the pyramidal knurls of the first roller embodiment.

In the roller bed 20 embodiment of the present invention, the rollers 22 are preferably provided with knurls 44, each of which has a generally pyramidal shape. These knurls may be formed by routing two sets of V-grooves 45, 46 of opposite hand in crisscrossing spiral paths along the length of the rollers starting from opposite ends. As indicated in FIG. 6, by way of example, each of the V-grooves in each set may have a mouth width of 0.25 inch (6.3 mm) and a depth of 0.10 inch (2.5 mm), and the lead angle on the spiral cuts may be 27 degrees.

Figure 3:
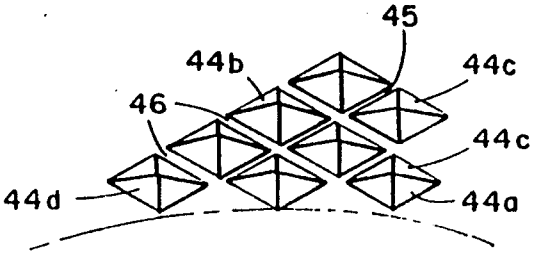
FIG. 3 is a detail view of a first embodiment of rollers taken as indicated in FIG. 4.
Figure 5:
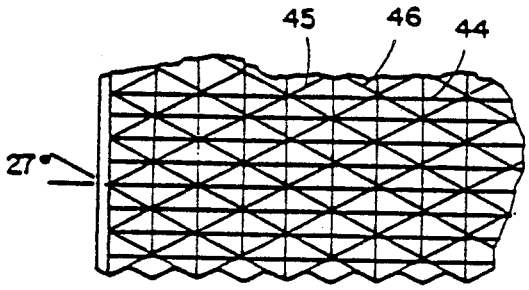
FIG. 5 is a fragmentary top plan view of one of the knurled rollers of the first roller embodiment.

Referring to FIG. 3, one of the V-grooves 45 results in the generally triangular, opposed faces **44*a*, 44*b* and one of the V-grooves 46 results in the generally triangular, opposed faces 44*c*, 44*d*. Each of the knurls 44 is hence formed by two adjoining V-grooves 45 and two adjoining V-grooves 46**.

Figure 12:
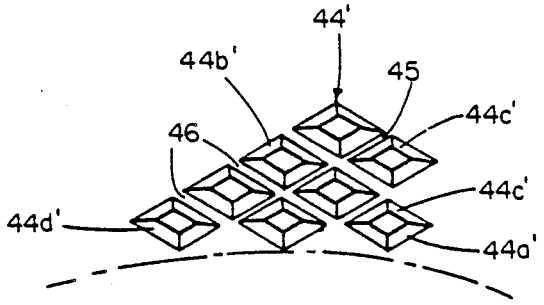
FIG. 12 is a view taken like FIG. 3 and illustrating a third roller embodiment having pyramidal knurls, each in the form of a frustum of a pyramid (frusto-pyramidal) rather than being a full pyramid.
Figure 13:
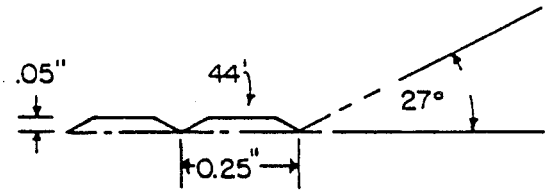
FIG. 13 is a fragmentary view to an enlarged scale showing an example of suitable dimensions for the knurls on the third roller.

Referring to FIG. 12, the pairs of adjoining V-grooves 45 and 46 may be separated such that the four faces **44*a–d* are trapezoids 44*a'*, *b'*, *c'*, and *d'* rather than triangles, thereby providing frusto-pyramidal knurls 44' separated by V-grooves 45' and 46'. As indicated in FIG. 13, the frusto-pyramidal knurls 44' may be given, for example, half the height of the full pyramidal knurls 44**.

It is preferred to chromium plate the rollers 44 to increase the wear life. In this regard, the rollers can be removed and replated from time to time.

Figure 7:
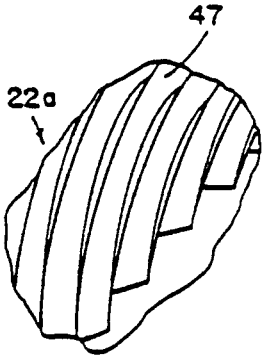
FIGS. 7 and 8 are views taken in a similar manner as FIGS. 3 and 4, and showing a second embodiment of rollers with protuberances in ridge form.
Figure 8:
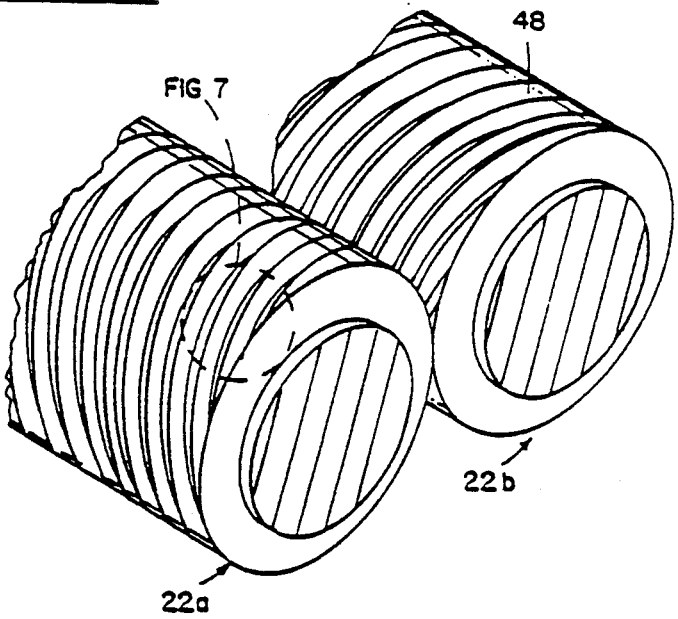

As an alternative to having all of the rollers 22 knurled as above described for separating out over-thick chips, some or all of the rollers may be formed with respective spiraling tapered ridges 47 and 48, as shown in FIGS. 7 and 8. These ridges 47 may be formed, for example, by routing only one set of V-grooves 45 or 46 rather than two sets on each roller. Rollers 22*a* may have the spiral of their V-grooves 45 in one direction, and rollers 22*b* may have the spiral of their V-grooves 46 of opposite hand. When used on a bed for separating out over-thick chips, the rollers 22*a* preferably alternate with respect to the rollers 22*b*. Ridged rollers 22*a*, 22*b* can be used for the entire bed, as shown in FIG. 10, or can be alternated with the knurled rollers 22, as indicated in FIG. 8, or in some other suitable pattern. In each instance, the protuberances (knurls or ridges) on the rollers are spaced apart between rollers by a gap (see FIG. 11) determining the maximum chip thickness desired, which commonly will be 8 mm. This gap has been exaggerated in the drawings for clarity.

Chips being processed to remove over-thick chips are fed into the rear portion of the bed 20 from an overhead hopper or chute (not shown) and are confined by the sidewalls 23, 24 and a sloped rear wall 49. Depending upon which rollers are used, the chips are tumbled by the knurls 44 on the rotating rollers 22 and by the tapered spiraling ridges 47, 48 on the rotating rollers 22*a*, 22*b* and are gradually simultaneously conveyed by the rollers toward the forward end of the bed 20 to discharge therefrom into a hopper or onto a discharge conveyer. When the ridged rollers 22*a*, 22*b* are used, as the chips tumble and move forwardly, the ridges 47, 48 tend to move the chips in a zigzagging travel path because the spirals of the ridges 47, 48 are of opposite hand.

The tumbling chips tend to tilt downwardly in the forward direction as they move between rollers. If the chips are not over-thick, they pass between the rollers. Over-thick chips nesting above the gap between two rollers are nudged by advancing chips therebehind sufficiently to cause the upwardly advancing portion of the roller at the front of the gap to move the over-thick chips ahead. Thus, the space above the gap between rollers (the nip) does not become clogged with over-thick chips. Ultimately, the over-thick chips discharge from the front of the bed 20 while the chips within the desired thickness range pass downwardly through the gaps between the rollers for further separating to remove the fines and pins therein.

Figure 14:
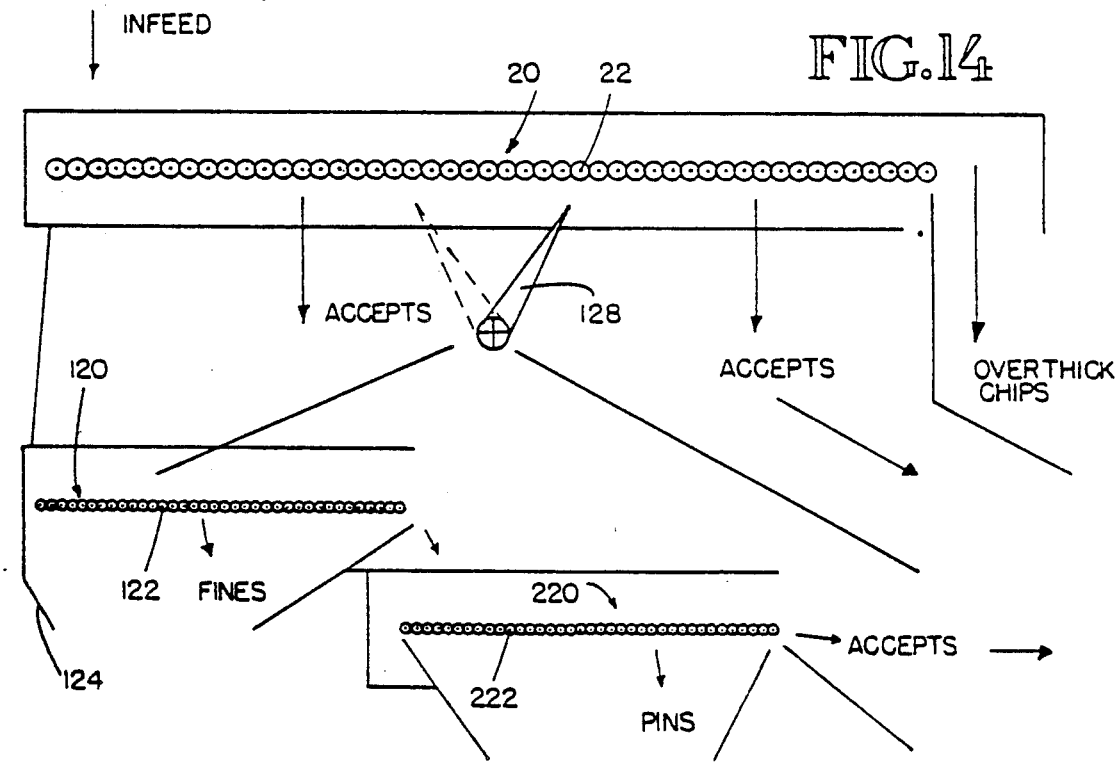
FIG. 14 is a side view illustrating a system for separating out over-thick chips, fines, and pins using three roller beds in accordance with the present invention.

In accordance with the present invention, it is preferred to next remove fines from the chip material after removing the over-thick chips. As shown in FIG. 14, this can be done efficiently by feeding acceptable chips with fines and pins onto a second bed 120 formed with rollers 122, like rollers 22 but preferably of smaller diameter (2.187 inches, for example), and with the protuberances of adjoining rollers spaced closer together, 0.06 inch (1.5 m), for example. On the second roller bed, it is preferred to use rollers of the type having either full pyramidal knurls 44 or frusto-pyramidal knurls 44'. When removing fines, it is preferred to have roller periphery speeds in the range of 50 to 150 feet per minute.

Normally, by the time the chips have traveled about halfway along the length of the first bed 20, substantially all of the fines and at least 80% of the pins have passed downwardly through the bed, together with acceptable chips. As indicated in FIG. 14, these acceptable chips and the fines and pins therein are guided by a diverter and funnel onto the infeed end of roller bed 120 as they drop from the first bed 20. The second bed 120 screens out the fines, which then drop into a hopper 124, for example, while the acceptable chips continue for the full length of the bed 120 to discharge onto a third roller bed 220, preferably of the type having rollers with pyramidal protuberances. The third roller bed 220 may be below the level of the second bed 120 or continue at the same level. The knurls on adjacent rollers on the third bed 220 may be spaced apart by a roller gap of about 3 mm, for example.

As the acceptable chips and pins are conveyed by the rollers along the third roller bed 220, most of the pins pass downwardly through the bed for collection in a hopper, for example, for later blending with the acceptable chips in a predetermined ratio or for burning with the fines if there is a surplus of pins. The acceptable chips discharge from the end of the bed 220 and are combined with the acceptable chips which pass through the second half of the first roller bed 20.

In a typical installation, the first roller bed 20 may have an arrangement of rollers 22*a*, 22*b* with ridge-type protuberances such as in FIG. 9, the second bed 120 may have rollers with frusto-pyramidal protuberances 44', and the third roller bed 220 may have rollers with full pyramidal protuberances 44. The dimensions of the ridges 47, 48 in the instance of the first roller bed 20 and the dimensions of the pyramidal protuberances 44 in the instance of the third roller bed 220 may be as indicated in FIG. 6. The dimensions of the frusto-pyramidal protuberances 44' in the instance of the second roller bed may be as indicated in FIG. 13. With such an arrangement of protuberance types as respects the three roller beds, and with roller gaps as previously indicated, the fines removal efficiency is in excess of 80% through a range of roll speeds from about 60 to 150 feet/minute when the loading rate of chip material fed to the first roller bed 20 is appropriately adjusted inversely to the roller speed. It will be appreciated that the gap between rollers may be varied depending upon the dimensional definition of fines and pins selected.

Regardless of protuberance profile or roller-to-roller gap, performance of the roller beds can be adjusted to optimize performance through a wide range of chip loading rates. Generally the fines removal efficiency decreases and the pin separation efficiency increases for a given roll speed as the chip loading rate is increased. For example, at a roll peripheral speed of 100 feet/minute, the fines removal efficiency declines from about 95% to about 80% when the chip loading rate is increased from a low loading rate to a high loading rate. Decreasing the depth of the valley between the protuberances in the fines removal roller bed 120 from 0.1 inch to 0.05 inch, for example, decreases the fines removal efficiency by about 20% but increases the pins separation efficiency (decreases pins loss) to an extent which may justify the increase of fines in the acceptable chips category. On the other hand, in other installations this decrease in fines removal efficiency may not be acceptable, in which case the roller beds 120 and 220 for fines removal and pins separation, respectively, may be the same except that the roller-to-roller gap will be greater in the roller bed 220.

For most pulp operations, it is not only desired to reject chips having a thickness in excess of about 8 mm, it is also preferred to reject chips having a length in excess of about 1¾ inches ("over-length" chips). In such a case, the rollers 22 are given an outward diameter of about 3½ inches and, namely, about twice the over-length limit. Referring to FIG. 11, when a chip is moving from the first quadrant of a roller toward the fourth quadrant of the next roller, with its length extending generally in the direction of travel, the leading end of the chip normally engages the fourth quadrant of the leading of the two rollers before the chip can assume a sufficiently vertical position to drop through the nip between the rollers. This engagement of the leading end of the chip with the leading roller and the continued engagement of the chip with the first quadrant of the trailing roller cause the chip to tilt upwardly at its leading end, as indicated in FIG. 11. The angle of tilt with the horizontal normally must exceed 45 degrees in order for the chip to shift to a substantially vertical position so that it can drop between the rollers. Otherwise, the forward propulsion effect of the fourth quadrant portion of the leading roller is so great that the chip is conveyed forwardly therebeyond. Ultimately, most of the over-length chips discharge with the over-thick chips at the forward end of the roller bed 20.

Although it is preferred to use rollers with pyramidal knurls, other tapered shapes can be used. Similarly, the tapered ridges 47, 48 can be varied in slope and lead angle.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A method of separating fines, pins, and over-thick chips from wood chip material to obtain acceptable wood chips, said method comprising:

feeding the chip material at an infeed end of a first roller screen having agitating and conveying rollers spaced apart to pass chips of acceptable thickness between such rollers and to discharge over-thick chips at a discharge end, said first roller screen having a leading length segment commencing at said infeed end along which most of the fines and pins pass therethrough together with acceptable chips;

delivering the pins, fines, and acceptable chips passing through said leading length segment of said first roller screen onto an infeed end of a second roller screen having agitating and conveying rollers adapted to pass the fines between such rollers and to discharge the pins and said acceptable chips at a discharge end;

delivering the pins and acceptable chips discharging from said second roller screen onto an infeed end of a third roller screen having chip agitating and conveying rollers adapted to pass the pins between such rollers and to discharge the acceptable chips at a discharge end;

collecting the pins; and combining the acceptable chips passing through the remainder of the length of said first roller screen following said leading length segment with the acceptable chips discharging from the discharge end of said third roller screen.

2. A method according to claim 1 in which the rollers in said second and third roller screens each have a pattern of crisscrossing tapered grooves forming pyramidal chip agitating and conveying protuberances.

3. A method according to claim 1 in which the rollers of said first, second, and third roller screens have chip agitating protuberances, the protuberances on the rollers of the first roller screen being spaced from the protuberances on the adjacent rollers by a gap larger than the gaps between the protuberances on adjacent rollers of the second roller screen and third roller screen, and the gap between the protuberances on adjacent rollers on the third roller screen being greater than the gap between the protuberances on adjacent rollers of the second roller screen.

4. A method according to claim 1 in which said leading end segment of the first roller screen extends about halfway along the length of the first roller screen.

5. A method according to claim 1 in which the material passing through said leading length segment feeds by gravity onto said second roller screen.

6. Apparatus for sorting wood chip material, comprising:

a first roller screen having chip agitating and conveying rollers spaced apart such as to pass chips of acceptable thickness between such rollers and to discharge over-thick chips at a discharge end;

a second roller screen arranged to receive pins, fines, and acceptable chips from said first roller screen and having chip agitating and conveying rollers spaced apart such as to pass fines between such rollers and to discharge pins and acceptable chips at a discharge end; and a third roller screen arranged to receive pins and acceptable chips from the discharge end of said second roller screen and having chip agitating and conveying rollers spaced apart such as to pass pins between such rollers and to discharge acceptable chips at a discharge end;

the rollers of said second roller screen having chip agitating and conveying protuberances of generally pyramidal shape formed by crisscrossing tapered grooves.

7. Apparatus according to claim 6 in which each of said rollers of the first roller screen has ship agitating and conveying protuberances of generally pyramidal shape formed by crisscrossing tapered grooves.

8. Apparatus according to claim 7 in which said grooves in the rollers of said first roller screen are shallower than said grooves in the rollers of said second roller screen.

9. Apparatus according to claim 6 in which the rollers in each of said roller screens are separated by gaps, the gaps in the first roller screen being wider than the gaps in the second and third roller screens, and the gaps in the second roller screen being narrower than the gaps in the first and third roller screens.

10. Apparatus according to claim 6 in which the rollers of said second and third roller screens have chip agitating and conveying protuberances formed by tapered spiral grooves, and the spiral grooves on the rollers of the second roller screen are shallower than the spiral grooves on the rollers of the third roller screen.

11. Apparatus for sorting fines and pins from wood chip material after removal of over-thick chips, said apparatus comprising:

a fines separating roller screen and a pins separating roller screen arranged in series and each having its rollers formed with generally pyramidal chip agitating and conveying protuberances formed by crisscrossing spiral grooves, the rollers in said fines separating roller screen being separated by a gap which is less than the gap separating the rollers in said pins separating roller screen.

12. Apparatus according to claim 11 in which the spiral grooves in the rollers of said fines separating roller screen are shallower than the spiral grooves in the rollers of said pins separating roller screen.

13. Apparatus according to claim 12 in which said generally pyramidal protuberances on the rollers of said fines separating roller screen are frusto-pyramidal in shape.

14. A roller screen comprising:

a roller bed defined by parallel side-by-side rollers separated from one another by a gap, each of said rollers having a uniform pattern of tapered, criss-crossing spiral grooves forming frusto-pyramidal protuberances; and means for rotating said rollers in the same direction of rotation.

15. A roller screen comprising:

a roller bed defined by parallel side-by-side rollers separated by a gap from one another, each of said rollers having a center rotary axis and a uniform pattern of like tapered protuberances which are radially equidistant from said rotary axis and have a frustum shape arranged with the base of the frustum at the minimum outside diameter of the roller and the other end of the frustrum at the maximum outside diameter of the roller, said gap being located between said maximum outside diameters of adjacent rollers; and means for rotating said rollers in the same direction of rotation.

* * * * *

UNITED STATES PATENT AND TRADEMARK OFFICE

CERTIFICATE OF CORRECTION

PATENT NO. : 5,109,988

DATED : May 5, 1992

INVENTOR(S) : Adrian Artiano

It is certified that error appears in the above-identified patent and that said Letters Patent is hereby corrected as shown below:

In column 8, claim 7, line 39, please delete "ship" and substitute therefor -- chip --.

Signed and Sealed this

Thirteenth Day of July, 1993

*Attest:*

Michael K. Kirk

MICHAEL K. KIRK

*Attesting Officer*

*Acting Commissioner of Patents and Trademarks*